United States Patent [19]

Krug, Jr. et al.

[11] 4,189,263

[45] Feb. 19, 1980

[54] SPARGER OUTLET HAVING SPARGER LOOP VALVE ASSEMBLY

[75] Inventors: John A. K. Krug, Jr., St Charles, Mo.; John W. Matthews, Madison, Ill.

[73] Assignee: ACF Industries, Incorporated, New York, N.Y.

[21] Appl. No.: 932,028

[22] Filed: Aug. 8, 1978

[51] Int. Cl.[2] ..... B65G 53/30; B65G 53/38

[52] U.S. Cl. ..... 406/137; 406/46

[58] Field of Search ..... 302/14, 15, 16, 52, 302/53; 239/107, 453, 570, 454; 222/195; 137/843, 852, DIG. 4, 854; 406/46, 86, 136, 137

[56] References Cited

U.S. PATENT DOCUMENTS

| | | | |
|---|---|---|---|
| 420,155 | 1/1890 | Hageman | 137/DIG. 4 X |
| 1,845,618 | 2/1932 | Miller | 239/454 |
| 2,933,102 | 4/1960 | Hillman et al. | 137/854 |
| 2,973,740 | 3/1961 | Hopkins et al. | 239/453 X |
| 3,552,799 | 1/1971 | Koranda | 302/14 |
| 3,620,023 | 11/1971 | Schmid | 239/570 X |
| 4,030,755 | 6/1977 | Heimke | 302/53 X |

FOREIGN PATENT DOCUMENTS

| | | | |
|---|---|---|---|
| 1170988 | 5/1964 | Fed. Rep. of Germany | 302/52 |

*Primary Examiner*—James L. Rowland

*Attorney, Agent, or Firm*—Henry W. Cummings

[57] ABSTRACT

In a sparger outlet, openings in a sparger loop are provided with specially designed check valves to reduce or eliminate the tendency of the lading to enter the loop through the openings. The openings in the loop include a hollow cylindrical seat portion. The seat member includes an opening in the interior portion thereof which communicates with the loop. The external portion of the seat member includes a circular seat adapted to receive a check valve in closed position. The seat portion may be formed in the loop or be a separate member. The check valve includes a stem portion extending through the seat, a tail portion which engages the interior portion of the seat member, and a head portion which in closed position seats on the seat. Either the stem portion and/or the tail portion is made of elastomeric material. The tail portion includes outwardly extending legs which engage the interior portion of the seat and bias the head portion into seated position on the seat. When fluid is circulated through the loop, the legs and/or the stem deform under fluid pressure to allow the head portion to move off its seat and fluid to enter the outlet for agitation. When the fluid pressure is turned off, the legs return to their original position and in so doing cause the heat portion to return to its original seated position. When the head portion is in seated position, the lading is prevented from entering the loop.

12 Claims, 5 Drawing Figures

SPARGER OUTLET HAVING SPARGER LOOP VALVE ASSEMBLY

BACKGROUND OF THE INVENTION

In covered hopper railway cars many materials are shipped dry. At destination water is added to the lading and the mixture is agitated with air distributed to the mixture through openings located in a loop in the hopper outlet.

However, lading often enters the openings in the loop. The openings become clogged with lading so that air cannot exit from the loop. Furthermore, the loop often gradually becomes filled with lading which reduces the amount of air which can be passed through the loop for agitation. This results in a longer time required to form a solution or slurry of the lading. In some instances the air loop becomes so filled with lading that the loop becomes completely blocked, and no air can circulate. This necessitates removing the outlet from the car and removing the air loop from the outlet for cleaning. Such cleaning is expensive and disruptive because the outlet must be temporarily taken out of service.

SUMMARY OF THE INVENTION

The object of the present invention is to provide a sparger outlet in which the air loop is provided with an arrangement for preventing the lading form entering the air loop when the outlet is in place and lading in the car.

In accordance with the present invention, in a sparger outlet the openings in the air loop are provided with specially designed check valves to reduce or eliminate the tendency of the lading to enter the air loop through the air openings.

The air openings in the loop include a hollow cylindrical seat portion. The seat member includes openings in the lower portion thereof which communicate with the air loop. The upper or external portion of the seat member includes a circular seat adapted to receive a check valve in closed position. The seat portion may be formed in the loop or be a separate member. The check valve includes a stem portion extending through the hollow seat and a tail portion which engages the lower or interior portion of the seat member, and a head portion which in closed position seats on the circular seat. In one embodiment the tail portion is made of elastomeric material and includes outwardly extending legs which engage the lower or interior portion of the seat and bias the head portion into seated position on the circular seat. When air is circulated through the loop, the legs deform under air pressure to allow the head portion to move off its seat and air to enter the outlet for agitation. When the air pressure is turned off, the elastomeric legs return to their original position and in so doing cause the head portion to return to its original seated position.

Instead of air, for some applications it is desirable to circulate other fluid mediums through the loop, such as water, as shown in U.S. Pat. No. 3,552,799.

In another embodiment the stem portion is made of elastomeric material and deforms when the air pressure is applied as the head portion moves off the seat to allow air to enter the outlet.

When the head portion is in seated position, the lading is prevented from entering the air loop. Thus blocking of the air loop openings by the lading is greatly reduced and/or substantially prevented. Furthermore, clogging and blocking of the air loop is greatly reduced and/or substantially prevented.

THE DRAWINGS

DESCRIPTION OF PREFERRED EMBODIMENTS

Figure 1:
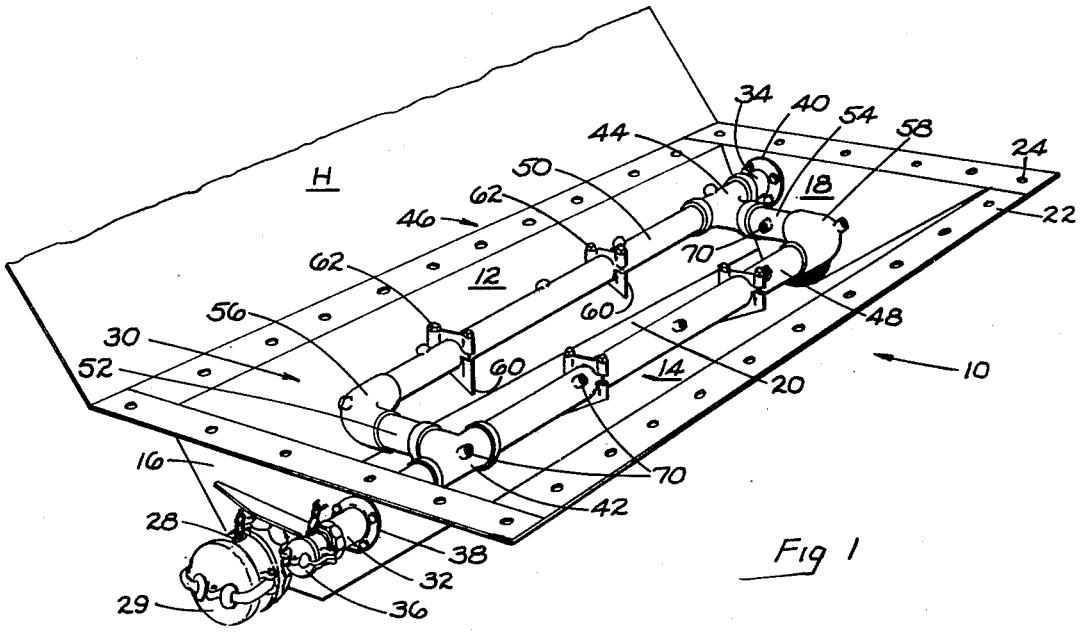
FIG. 1 is a schematic perspective view of a sparger outlet including the sparger valve assemblies of the present invention.

A sparger outlet is shown in the drawings, indicated generally at 10. The outlet includes side walls 12 and 14, and end walls 16 and 18. An outlet discharge opening 20 is located between the inner ends of side walls 12 and 14. The side walls and end walls include an upper flange portion 22, including openings 24 which receive fasteners 26 which attach the outlet to a hopper H, a portion of which is indicated schematically in FIG. 1.

Opening 20 is in communication with a discharge conduit 28 extending below outlet walls 12 and 14 and extending out below end walls 16 and 18. A removable cap 29 covers discharge conduit 28.

Located within the outlet is a sparger air loop 30. Air loop 30 includes a pair of inlet pipes 32 and 34, each including a suitable cap 36. Flanges 38 and 40 support the inlet pipes which extend through respective end walls 16 and 18. Pipes 32 and 34 are connected to T connectors 42 and 44. An air loop 46 includes longitudinal pipes 48 and 50 and transverse pipe portions 52 and 54. Elbows 56 and 58 respectively join longitudinal pipe 50 with transverse pipe 52, and longitudinal portion 48 with transverse portion 54. Brackets 60 having pipe clamps 62 support the longitudinal pipes 48 and 50 above the respective outlet walls 12 and 14.

Figure 2:
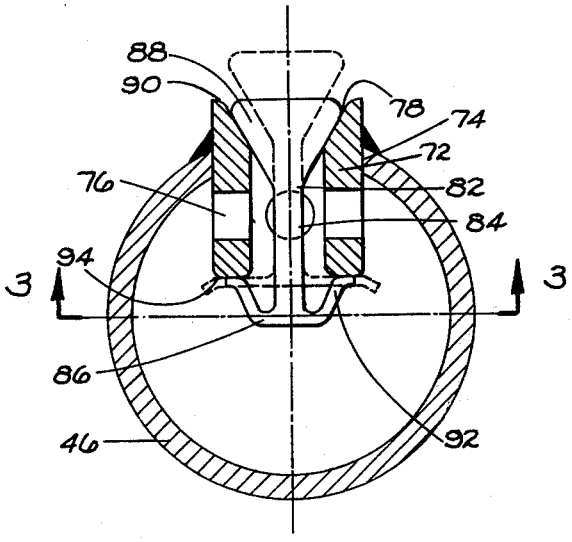
FIG. 2 is a vertical sectional view through the sparger loop illustrating the sparger valve assemblies of the present invention.
Figure 3:
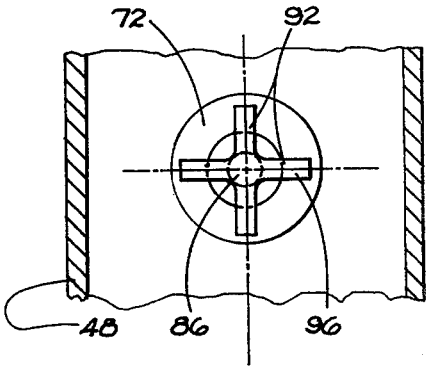
FIG. 3 is a bottom view looking in the direction of the arrows along the line 3—3 in FIG. 2.

Located within pipes 48, 50, 52 and 54 are a plurality of sparger valve assemblies 70. Each of the sparger valve assemblies 70 is constructed in the same manner. As shown in FIGS. 2 and 3, the valve assemblies 70 include a hollow cylindrical valve seat member 72 extending within openings 74 in air loop 46. Valve seat 72 includes openings 76 located in the lower portion thereof, in fluid communication with one of the pipes 48, 50, 52 or 54. A circular valve seat 78 is formed in the upper portion of valve seat member 72. Circular valve seat 78 is tapered to facilitate a valve seating in closed position.

A valve member 82 includes a stem portion 84 extending within hollow cylinder seat member 72 and having a tail portion 86 at the lower or inner end, and a valve portion 88 at its upper or outer end. Valve portion 88 is preferably solid and includes a circular tapered surface 90 which engages tapered valve seat surface 78 in closed and seated position.

Tail portion 86 includes a plurality of legs 92 which in closed position extend upwardly and outwardly to engage the bottom 94 of seat member 72. Legs 92 include a flange portion 96 which engage the bottom in closed position.

Tail portion 86 includes a plurality of legs 92 which in closed position extend upwardly and outwardly to engage the bottom 94 of seat member 72. Legs 92 include flange portion 96 which engage the bottom in closed position.

Tail portion 86 is made of elastomeric material. Thus when a source of air pressure is connected to one or both of pipes 32 or 34 the legs 92 deform elastically and assume the position shown dotted in FIG. 2 in which legs 92 extend generally at right angles to cylindrical seal member 72. Valve portion 88 is lifted by the air pressure off seat 78 to assume the dotted position shown in FIG. 2. In addition, stem portion 84 is preferably made of elastomeric material and also deforms elastically as valve portion 88 is lifted from its seat 78. It also should be noted that the taper of the seat 78 has a nozzle effect on the air, directing the air outwardly into the outlet.

Figure 4:
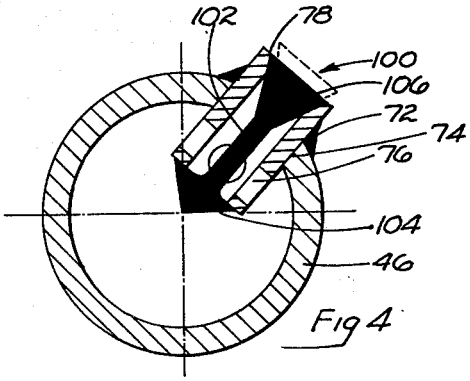
FIG. 4 is a sectional view of another embodiment of the present invention.

In another embodiment of the invention shown in FIG. 4, valve member 100 includes a stem portion 102 and a tail portion 104 of button shape. In this embodiment stem portion 102 is made of elastomeric material and is relatively thin. When air under pressure is circulated through loop 46 and enters openings 76, stem portion 102 deforms elastically to allow valve portion 106 to allow air to enter the outlet 10. Since tail portion 104 is of button shape, it does not deform elastically to a great extent. It is apparent however from comparing the embodiments shown in FIG. 4 with the embodiment shown in FIGS. 2 and 3, that either the tail portion and/or the stem portion of the valve member may deform elastically to allow the valve portion to move to open position to allow air to enter the outlet.

Figure 5:
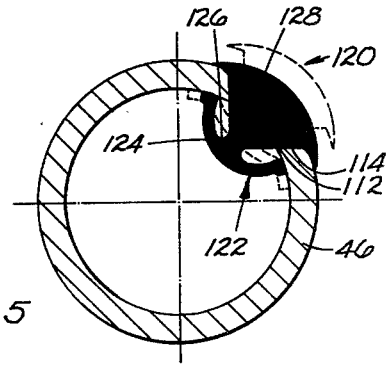
FIG. 5 is a sectional view of an embodiment in which the seat portion is formed in the loop.

In still another embodiment shown in FIG. 5 the seat is formed in the loop 46. Thus a separate seat member is not needed and the welds to hold the separate seat members in place may be eliminated. Openings 112 formed in loop 46 are provided with a taper 114 which functions as a valve seat for valve member 120. To some degree, tapered seat portion 114 also functions as a nozzle. Valve member 120 includes a tail portion 122 having legs 124 made of elastomeric material similar to legs 92. In this embodiment legs 124 engage an interior seat portion which is the internal surface of loop 46. A stem portion 126 is foreshortened compared to the previous embodiments and is attached to a valve portion 128 which engages tapered seat portion 114.

In operation, cap 29 is removed and a source of water is connected to discharge conduit 28. A source of air pressure is connected to one or both of air conduits 32 or 34. The water passes inwardly through conduit 28 and up through opening 20 and mixes with the lading located in outlet 10 and in hopper H. If the lading dissolves in the water, a solution is formed. To the extent that the lading does not dissolve, a slurry is formed. It is common practice to cycle the solution and/or slurry through the car until a desird concentration and/or slurry consistency is obtained. Reference may be made to U.S. Pat. No. 3,451,724 for a description of such cycling and a description of suitable apparatus for such cycling. This patent is hereby incorporated into the present application by this reference. The use of standpipe 15 in U.S. Pat. No. 3,451,724 is optional. During the slurry and/or solution formation the air pressure in air loop 46 moves valve members 82, 100 and 120 into the position shown dotted in FIGS. 2, 4 and 5 respectively with valve portions 88, 106 and 128 spaced from respective valve seats 78, 78 and 114 to allow air to enter outlet 10 and agitate the air/water mixture to aid in slurry and/or solution formation.

When the air pressure is turned off the valve members return to the position shown solid in FIG. 2. Valve portions 88, 106 and 128 is seated position on valve seat 78 substantially prevent lading, water, solution or slurry from entering the loop 46. The valve assemblies 70 are thus not clogged and can be used again for solution and/or slurry unloading. Furthermore the loop 46 is substantially free of lading and/or congealed lading coming out of solution. Thus in subsequent solution or slurry unloadings the effective cross section of the loop available for air agitation is not reduced. Thus the maximum amount of air for the loop volume can be passed through the loop for a given pressure. Instead of air for some applications it is desirable to circulate other fluid mediums through the loop, such as water as illustrated in U.S. Pat. No. 3,552,799.

It is thus seen that the sparger valve assembly of the present invention prevents clogging of openings 74 and 112 in the loop and also prevents clogging and blocking of the loop. This results in improved agitation and a large reduction in the amount of downtime of the outlet due to improper operation of the sparger loop.

What is claimed is:

1. A sparger loop comprising: a hollow tubular member having an inlet and a continuous loop portion, said continuous loop portion including a plurality of fluid openings; said openings in the loop portion each including a hollow seat in fluid communication with said loop; said seat having an external portion adapted to receive a check valve in closed position and an interior portion located in said loop; a check valve including a stem portion extending through said seat and a tail portion which engages the interior portion of the seat; said check valve further including a head portion connected to the upper end of said stem portion which in closed position seats on said seat; at least one of said stem and said tail portion being made of elastomeric material; said tail portion engaging the interior portion of said seat; said head portion being biased into seated position on said seat; whereby when fluid under pressure is circulated through said loop, at least one of said stem and tail portions deform under fluid pressure to allow the head portion to move off said seat and fluid to exit continuously from the loop when said head portion is spaced from said seat, and whereby when the fluid pressure is turned off, the head portion returns to its original seated position, whereby when the head portion is in seated position, material adjacent the loop is substantially prevented from entering the loop.

2. A sparger air loop according to claim 1 wherein the tail portion of the valve member is made of elastomeric material which deforms when the air pressure is applied.

3. A sparger air loop according to claim 2 wherein the stem portion of the valve member is made of elastomeric material and which deforms when the air pressure is applied.

4. A sparger air loop according to claim 1 wherein the stem portion of the valve member is made of elastomeric material and which deforms when the air pressure is applied.

5. A sparger air loop according to claim 1 wherein a separate seat member is provided in said air openings.

6. A sparger air loop according to claim 1 wherein said seat is formed in said air openings.

7. A sparger outlet comprising: laterally spaced side walls extending inwardly and downwardly, the inner ends defining a sparger outlet opening; end walls attached to opposite ends of said side walls; a discharge conduit located below said sparger outlet opening and extending outwardly of said end walls; a hollow tubular member having an inlet located outside of said outlet and a continuous loop located inside said outlet; said continuous loop including a plurality of fluid openings; said fluid openings in the loop including a seat in fluid communication with said loop; said seat having an external portion adapted to receive a check valve in closed position and an interior portion located within said loop; a check valve including a stem portion extending through said seat and a tail portion which engages said interior portion; said check valve further including a head portion connected to the upper end of said stem which in closed position seats on said seat; one of said stem and said tail portion being made of elastomeric material; said head portion being biased into seated position on said seat; means for circulating fluid under pressure through the loop, whereby said elastomeric material deforms under fluid pressure to allow the head portion to move off its seat and fluid to continuously exit from said loop and enter the outlet when said head portion is spaced from said seat; and whereby when the fluid pressure is turned off, the elastomeric material returns to its original position and in so doing causes the head portion to return to its original seated position on said seat, whereby lading is substantially prevented from entering said loop.

8. An outlet according to claim 7 wherein the tail portion of the valve member is made of elastomeric material which deforms when the air pressure is applied.

9. An outlet according to claim 7 wherein the stem portion of the valve member is made of elastomeric material which deforms when the air pressure is applied.

10. An outlet according to claim 9 wherein the tail portion of the valve member is made of elastomeric material which deforms when the air pressure is applied.

11. An outlet according to claim 7 wherein a separate seat member is provided in said air openings.

12. An outlet according to claim 7 wherein said seat is formed in said air openings.

* * * * *

UNITED STATES PATENT AND TRADEMARK OFFICE

CERTIFICATE OF CORRECTION

PATENT NO. : 4,189,263

DATED : February 19, 1980

INVENTOR(S) : John A. K. Krug, Jr., et.al.

It is certified that error appears in the above-identified patent and that said Letters Patent are hereby corrected as shown below:

Column 1, line 28, "form" should read --from--.
Column 3, line 57, "desird" should read --desired--.
Column 4, line 5, "is" should read --in--.

Signed and Sealed this

*Second* Day of *December 1980*

[SEAL]

*Attest:*

SIDNEY A. DIAMOND

*Attesting Officer*

*Commissioner of Patents and Trademarks*